US010875670B2

(12) United States Patent
Bonneville et al.

(10) Patent No.: US 10,875,670 B2
(45) Date of Patent: Dec. 29, 2020

(54) WEB-PACKAGING MACHINES WITH MULTIPLE SEALING STATIONS

(71) Applicant: Alkar-RapidPak, Inc., Lodi, WI (US)

(72) Inventors: Craig R. Bonneville, Black Earth, WI (US); Daryl W. Shackelford, Waunakee, WI (US)

(73) Assignee: Alkar-RapidPak, Inc., Lodi, WI (US)

( * ) Notice: Subject to any disclaimer, the term of this patent is extended or adjusted under 35 U.S.C. 154(b) by 236 days.

(21) Appl. No.: 15/655,379

(22) Filed: Jul. 20, 2017

(65) Prior Publication Data

US 2018/0127121 A1 May 10, 2018

Related U.S. Application Data

(60) Provisional application No. 62/481,990, filed on Apr. 5, 2017, provisional application No. 62/417,658, filed on Nov. 4, 2016.

(51) Int. Cl.

| | |
|---|---|
| ***B65B 9/04*** | (2006.01) |
| ***B65B 25/06*** | (2006.01) |
| ***B65B 31/02*** | (2006.01) |
| ***B65B 47/04*** | (2006.01) |
| ***B65B 5/06*** | (2006.01) |
| ***B65B 9/08*** | (2012.01) |
| ***B65B 51/14*** | (2006.01) |

(Continued)

(52) U.S. Cl.

CPC ..... *B65B 9/04* (2013.01); *B65B 5/06* (2013.01); *B65B 9/08* (2013.01); *B65B 11/50* (2013.01); *B65B 25/062* (2013.01); *B65B 31/02* (2013.01); *B65B 47/04* (2013.01); *B65B 51/14* (2013.01); *B65B 31/00* (2013.01)

(58) Field of Classification Search

CPC ..... B65B 9/04; B65B 7/2878; B65B 31/021; B65B 41/00; B65B 47/00; B65B 47/04; B65B 59/04; B65B 7/164; B65B 11/52; B65B 41/12; B65B 51/26; B65B 65/003; B65B 2230/02; B29C 65/00; B29C 66/71; B29C 66/8432

USPC ..... 53/559, 453, 75, 329, 329.2, 373.5, 53/329.3, 389.2, 546, 553

See application file for complete search history.

(56) References Cited

U.S. PATENT DOCUMENTS 4,294,859 A * 10/1981 Lundquist ..... B65B 31/021 426/129

4,506,488 A * 3/1985 Matt ..... B65B 57/00 53/450

(Continued)

*Primary Examiner* — Hemant Desai
*Assistant Examiner* — Jacob A Smith
(74) *Attorney, Agent, or Firm* — Andrus Intellectual Property Law, LLP

(57) ABSTRACT

A web packaging machine for enclosing a food product within a food product package has a first sealing station that seals an upper web of packaging material to a lower web of packaging material to thereby partially enclose the food product in the food product package and a second sealing station configured to further seal the upper web of packaging material to the lower web of packaging material to thereby fully enclose the food product in the food product package. A lower web transport conveyor conveys the lower web of packaging material from upstream to downstream first through the first sealing station and then through the second sealing station.

14 Claims, 8 Drawing Sheets

(51) Int. Cl.
*B65B 11/50* (2006.01)
*B65B 31/00* (2006.01)

(56) References Cited

U.S. PATENT DOCUMENTS 4,951,444 A * 8/1990 Epstein ..... B29C 51/46 53/433
5,170,611 A 12/1992 Buchko et al.
5,205,110 A * 4/1993 Buchko ..... B26D 5/00 53/453
5,379,572 A * 1/1995 Giovannone ..... B29C 66/91445 53/478
5,408,804 A * 4/1995 Schroder ..... B65B 9/042 53/240
5,623,810 A * 4/1997 Dey ..... B65B 9/04 53/281
5,868,244 A * 2/1999 Ivanov ..... B65B 11/50 206/439
5,983,607 A * 11/1999 Mihalov ..... B29C 65/18 53/478
7,490,448 B1 2/2009 Bonneville et al.
7,775,017 B2 * 8/2010 Stowell ..... B29C 66/53461 53/287
7,833,002 B2 * 11/2010 Buchko ..... B65B 47/06 425/383
8,186,134 B2 5/2012 Shackelford et al.
8,407,973 B2 * 4/2013 Finkowski ..... B65B 7/164 53/540
8,424,273 B2 * 4/2013 Bernig ..... B32B 27/32 53/442
8,474,226 B2 * 7/2013 Izquierdo ..... B65B 61/08 53/389.2
8,499,536 B2 8/2013 Bonneville
8,596,026 B2 * 12/2013 Doll ..... B65B 9/02 53/405
8,615,973 B2 * 12/2013 Mondry ..... B65B 25/08 53/511
8,720,169 B2 * 5/2014 Ehrmann ..... B65B 51/14 53/559
9,021,770 B2 * 5/2015 Krahl ..... B29C 65/18 53/329
2009/0272073 A1 * 11/2009 Meyer ..... B65B 47/02 53/141
2011/0139661 A1 * 6/2011 Ludwig ..... B29C 66/1312 206/462
2012/0031049 A1 * 2/2012 Doll ..... B65B 9/02 53/432
2012/0037271 A1 * 2/2012 Davidson ..... B65B 1/06 141/129
2012/0201481 A1 * 8/2012 Mondry ..... B65B 9/04 383/105
2012/0292422 A1 11/2012 Bonneville et al.
2012/0324835 A1 * 12/2012 Ickert ..... B29C 66/92921 53/476
2013/0055688 A1 * 3/2013 Jokele ..... B65B 57/00 53/476
2013/0074664 A1 * 3/2013 Ewald ..... B65B 61/065 83/13
2013/0118117 A1 * 5/2013 Grobbel ..... B29C 66/8322 53/329.2
2014/0150377 A1 * 6/2014 Ehrmann ..... B65B 9/04 53/453
2014/0331602 A1 * 11/2014 Newman ..... B29C 66/8161 53/405
2015/0096263 A1 * 4/2015 Ehrmann ..... B65B 9/04 53/411
2015/0259086 A1 * 9/2015 Ahn ..... B29C 66/131 53/329.3
2015/0336691 A1 * 11/2015 Fowler ..... B65B 51/026 206/524.7
2018/0134475 A1 * 5/2018 Newman ..... B65D 85/54

* cited by examiner

WEB-PACKAGING MACHINES WITH MULTIPLE SEALING STATIONS

CROSS-REFERENCE TO RELATED APPLICATIONS

The present application is based on and claims priority to U.S. Provisional Patent Application No. 62/417,658 filed Nov. 4, 2016 and 62/481,990 filed Apr. 5, 2017, the disclosures of which are incorporated herein by reference.

FIELD

The present disclosure relates to web packaging machines, specifically web packaging machines with multiple sealing stations.

BACKGROUND

The following patents are incorporated herein by reference in entirety:

U.S. Pat. No. 5,170,611 discloses an apparatus and method for supplying web material to an indexing advancement mechanism, such as may be associated with a packaging machine which forms the web into a component of a package. The web is supplied from a supply roll to an unwind mechanism, which continuously unwinds the web during indexing advancement of the web by the advancement mechanism of the packaging machine. The unwind mechanism includes an unwind motor which is operable to vary the rate at which the web is unwound from the supply roll.

U.S. Pat. No. 5,205,110 discloses an indexing motion apparatus and method for vacuum packaging of articles such as hot dogs, sliced luncheon meat, cheese or pharmaceuticals. A lower web of packaging material is indexingly advanced by a lower web drive driven in an indexing manner by a servo motor. Forming tooling is provided for vacuum forming the lower web to form one or more product cavities, and the forming tooling is movable between raised and lowered positions by a lifting and lowering system driven by a servo motor. A plug assist mechanism is provided for assisting the web to conform to the forming cavities. The plug assist mechanism is also movable in response to operation of servo motors, which actuate a pair of linear actuators. After the formed product cavities are loaded with product, the cavities are evacuated and an upper web applied to vacuum package the product. A slitting mechanism severs the upper and lower webs into individual product packages. The servo motors are programmable and provide accurate position of the components of the packaging machine, and also provide ease in changing the various parameters of the packaging machine according to the type of product being packaged.

U.S. Pat. No. 7,490,448 discloses a form-fill-seal web packaging system that includes a pressure monitor at the sealing station to monitor a sealing pressure. A bladderless actuator effects relative movement of dies and applies the sealing pressure.

U.S. Pat. No. 8,186,134 discloses packaging machines that include a web transport conveyor for transporting a web of flexible packaging material from upstream to downstream locations through a series of stations and packaging apparatuses. A forming station and a closing station each have movable die members that are counterbalanced.

U.S. Pat. No. 8,499,536 discloses packaging machines that include a web transport conveyor transporting a web of flexible packaging material from upstream to downstream locations through a series of stations.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a web packaging machine that encloses a food product within a food product package formed by a lower web of packaging material and an upper web of packaging material includes a first sealing station configured to seal the upper web of packaging material to the lower web of packaging material to thereby partially enclose the food product in the food product package; a second sealing station configured to further seal the upper web of packaging material to the lower web of packaging material to thereby fully enclose the food product in the food product package; and a lower web transport conveyor configured to convey the lower web of packaging material from upstream to downstream first through the first sealing station and then through the second sealing station.

In certain examples, a web packaging machine encloses food products within food product packages formed by a lower web of packaging material and an upper web of packaging material. The web packaging machine includes a first sealing station that seals the upper web of packaging material to the lower web of packaging material to thereby fully enclose a first food product in a first food product package; a second sealing station that seals the upper web of packaging material to the lower web of packaging material to thereby fully enclose a second food product in a second food product package; and a lower web transport conveyor that conveys the lower web of packaging material from upstream to downstream first through the first sealing station and then through the second sealing station.

Various other features, objects, and advantages will be made apparent from the following description taken together with the drawings.

BRIEF DESCRIPTION OF THE DRAWINGS

The present disclosure is described with reference to the following figures. The same numbers are used throughout the figures to reference like features and like components.

DETAILED DESCRIPTION OF THE DRAWINGS

In the present description, certain terms have been used for brevity, clarity and understanding. No unnecessary limitations are to be inferred therefrom beyond the requirement of the prior art because such terms are used for descriptive purposes only and are intended to be broadly construed. The different apparatuses, systems, and methods described herein may be used alone or in combination with other apparatuses, systems, and methods. Various equivalents, alternatives and modifications are possible within the scope of the appended claims.

Figure 1:
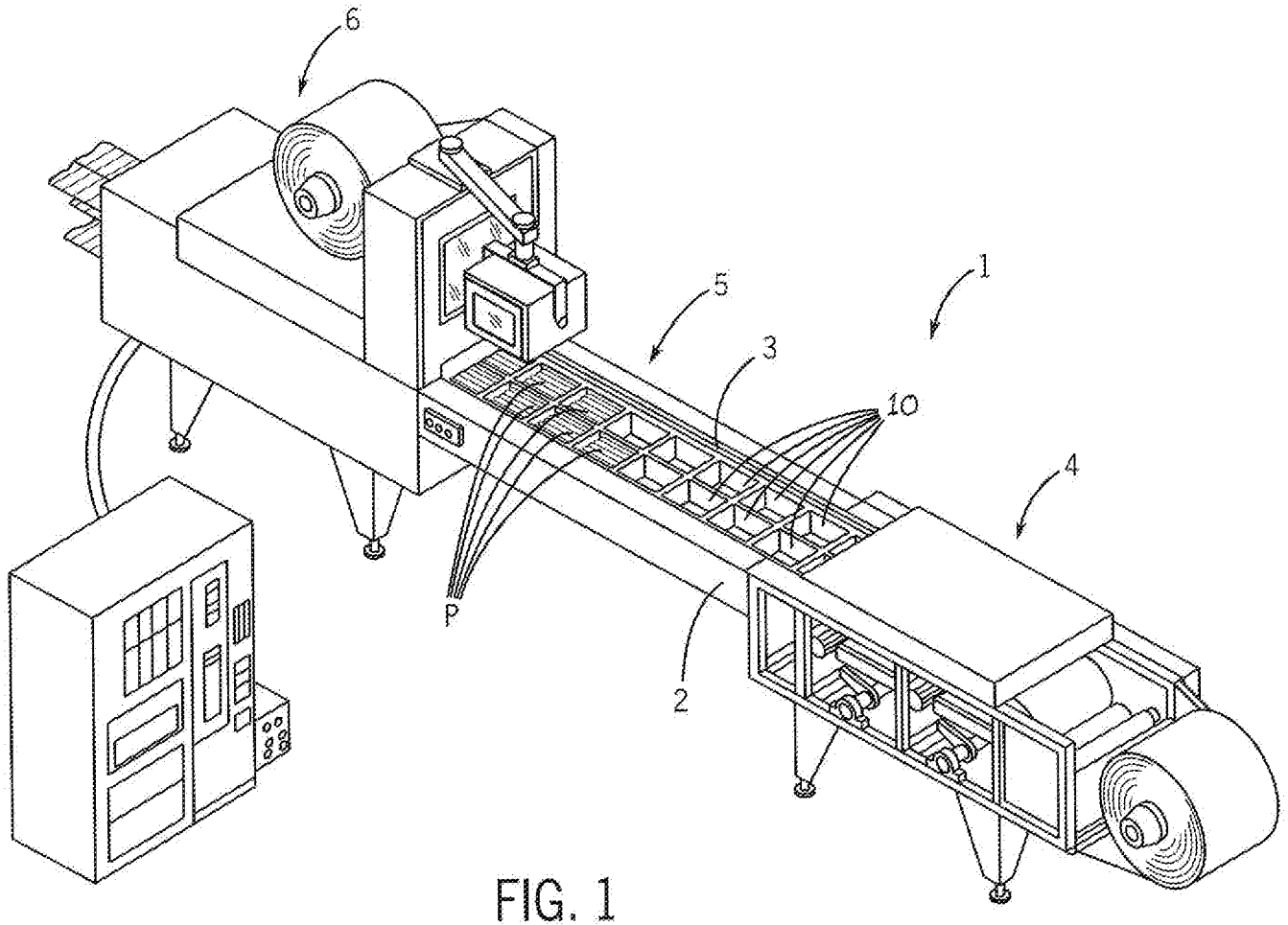
FIG. 1 PRIOR ART
FIG. 1 is a perspective view of a conventional web packaging machine with a single sealing station.

FIG. 1 depicts an example conventional web packaging machine 1 disclosed in the above-incorporated U.S. Pat. No. 5,170,611. The web packaging machine 1 is configured to form a food product package 10 from lower and upper webs of flexible packaging material. A web transport conveyor 3 is configured to transport a lower web of packaging material from upstream to downstream through a series of stations that are supported by a frame 2 of the web packaging machine 1. A forming station 4 forms a food product cavity in the lower web. A filling station 5 fills the food product cavity with food product. A closing or sealing station 6 encloses the food product in the food product cavity by sealing the upper web to the lower web, thereby forming the food product package 10. Optionally, a cutting station cuts the upper and lower webs into separate food product packages 10.

It is known to equip a web packaging machine 1 with a sealing station to enclose the food product in the food product package 10. In operation, the sealing station has sealing die members that seal the upper and lower webs of packaging material. At least one of the sealing die members is moveable relative to the other such that the sealing die members engage the webs of packaging material and apply heat and pressure to thermally adhesively seal the upper and lower webs of packaging material to each other. Sealant is pre-applied to the upper web and/or lower web and the sealing die member is equipped with a heater that applies heat which activates the sealant to thermally adhesively seal the upper and lower webs of packaging material webs to each other. Reference is made to above incorporated U.S. Pat. No. 7,490,448 for further description of the sealing station and operation thereof.

The sealing station 6 typically includes a very large and unwieldy sealing die member that is configured to contact and seal the upper web of packaging material to the lower web of packaging material. However, the size and weight of the sealing die member can make adjusting, maintaining, removing, and/or replacing the sealing die member or other components positioned at the sealing station 6 difficult. Furthermore, it is often difficult to rapidly and uniformly evacuate and seal large matrices of food product packages 10 and drive large seal bars down against bottom sealing die members to create a uniform sealing pressure in web packaging machines that utilize a single sealing station 6.

Accordingly, through research and experimentation, the present inventors have recognized that web packaging machines can be improved by including multiple sealing stations, i.e. replacing a single sealing station with multiple sealing stations. In particular, the present inventors have discovered that web packaging machines with multiple sealing stations achieve fast and uniform package evacuation, create consistent and uniform sealing pressures, and package the food product at an increased or a high rate of speed in comparison to conventional web packaging machines with a single sealing station. Additionally, ergonomic problems associated with lifting, repairing, and/or removing heavy sealing die members are greatly reduced and/or eliminated by utilizing web packaging machines with multiple sealing stations. In operation, the multiple sealing stations can be configured to perform the same functions as the single sealing station utilized on conventional web packaging machines. Furthermore, each of the multiple sealing stations can be further configured to perform identical or different functions relative to each other, the multiple sealing stations can utilize the same actuator or independent actuators, and/or the multiple sealing stations can be programmed independently of each other.

Figure 2:
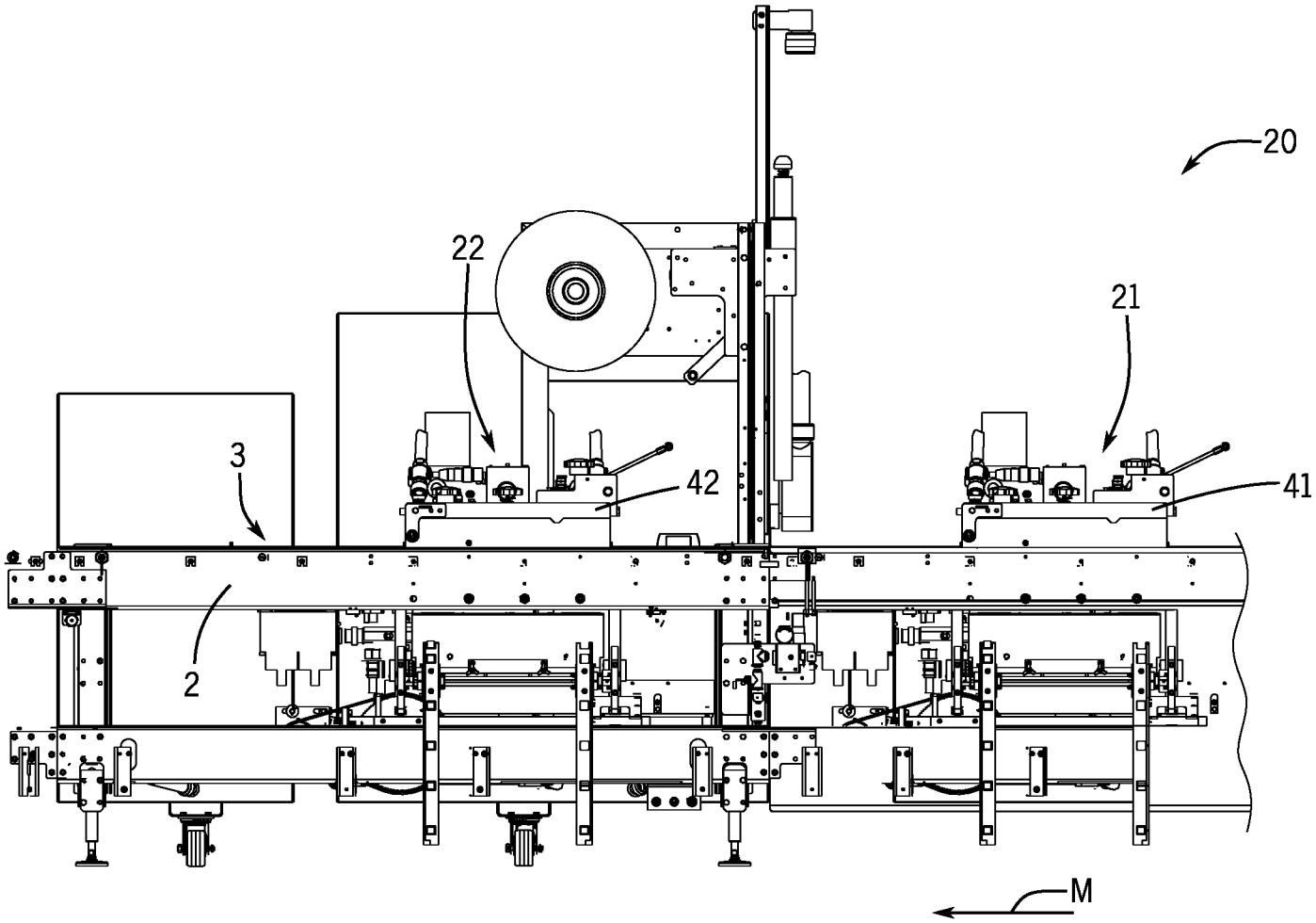
FIG. 2 is a partial side view of an example web packaging machine with multiple sealing stations.

FIG. 2 depicts an example web packaging machine 20 with multiple sealing stations, namely a first sealing station 21 and a second sealing station 22. The first sealing station 21 and the second sealing station 22 are spaced apart along the lower web transport conveyor 3, and the lower web transport conveyor 3 is configured to convey the lower web of packaging material from upstream to downstream first through the first sealing station 21 and then through the second sealing station 22 (see motion arrow M). One having ordinary skill in the art will recognize that any number of sealing stations can be utilized with the web packaging machine 20.

The first sealing station 21 and the second sealing station 22 can be configured to seal different areas of the upper web of packaging material to the lower web of packaging of material. Accordingly, part of the food product package 10 is sealed by the first sealing station 21 and the rest of, i.e. the remainder, of the food product package 10 is sealed by the second sealing station 25.

Figure 3:
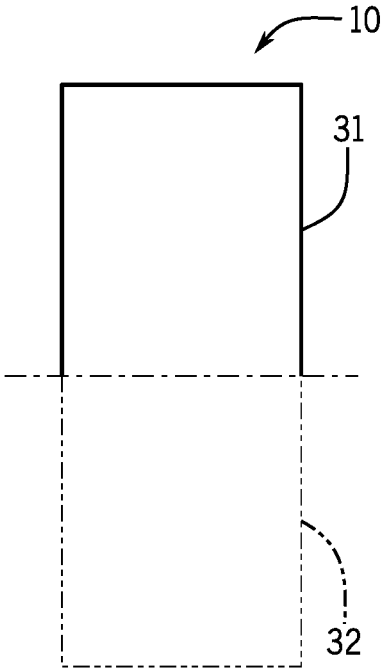
FIG. 3 is an outline of an example food product package that is partially sealed. A sealed, first section of the food product package is depicted by thick, solid lines, and an unsealed, second section of the food product package is depicted by dashed lines.
Figure 4:
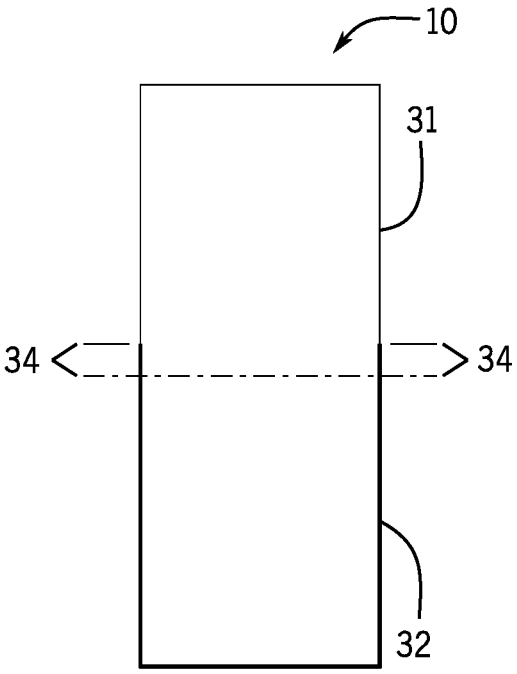
FIG. 4 is a view like FIG. 3 depicting the example food product package of FIG. 3 fully sealed. The sealed, first section of the food product package is depicted by thin, solid lines and a sealed, second section of the food product package is depicted by thick, solid lines.

For example, referring to FIGS. 3-4, the outline of a food product package 10 is depicted. FIG. 3 depicts the food product package 10 at the first sealing station 21 (FIG. 2) which is configured to seal the upper web of packaging material to the lower web of packaging material at or along a first section 31 (see thick solid lines) of the food product package 10 to thereby seal part of the food product package 10 (i.e. partially enclose a food product in the food product package 10). The partially sealed food product package 10 is conveyed from upstream to downstream to the second sealing station 25 (FIG. 2) as the lower web transport conveyor 3 conveys the lower web of packaging material. At the second sealing station 25, the upper web of packaging material is sealed to the lower web of packaging material at or along a remaining, second section 32 (see thick solid line on FIG. 4, note the thin solid line on FIG. 4 depicts the first section 31 which has already been sealed by the first sealing station 21) of the food product package 10 to thereby seal the rest or remainder of the food product package 10 (i.e. fully enclose the food product in the food product package 10).

Any number of food product packages can be partially sealed by the first sealing station 21 and then fully sealed by the second sealing station 25. Furthermore, the shape and size of the first and second sections 31, 32 of the food product package(s) 10 can vary. Accordingly, a plurality of food products (e.g. string cheese) can be individually enclosed in a corresponding number of food product packages 10. The food product packages can then be separated from each other by the packager or the consumer.

Figure 5:
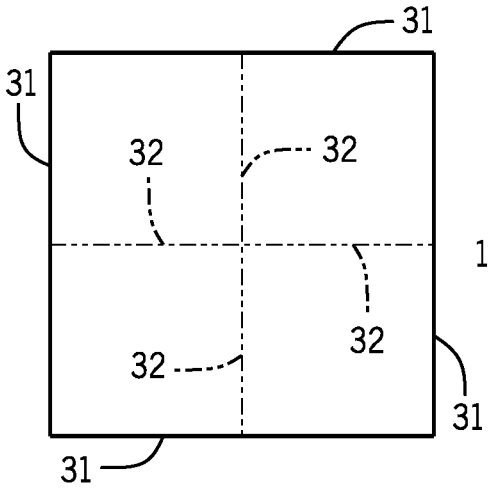
FIG. 5 is an outline of four example food product packages that are each partially sealed. Each food product package has a sealed, first section depicted by thick, solid lines, and an unsealed, second section depicted by dashed lines.
Figure 6:
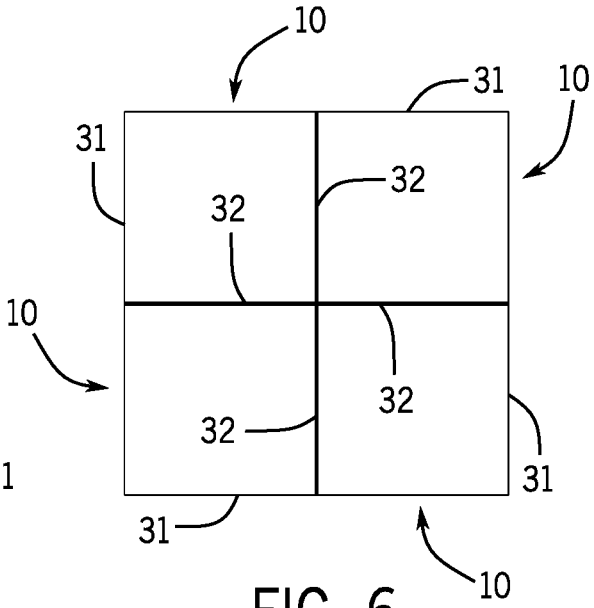
FIG. 6 is a view like FIG. 5 depicting the four example food product packages of FIG. 3 fully sealed. The sealed, first sections of the food product packages are depicted by thin, solid lines and the sealed, second sections of the food product packages are depicted by thick, solid lines.

For example, referring to FIGS. 5-6, the outlines of four food product packages 10 are depicted. In this example, referring to FIG. 5, the first sealing station 21 (FIG. 2) seals the upper web of packaging material to the lower web of packaging material at each first section 31 (see thick solid line on FIG. 5) of the four food product packages 10 such that each food product package 10 is partially sealed. Then, the second sealing station 22 (FIG. 2) seals the upper web of packaging material to the lower web of packaging material at each second section 32 (thick solid line on FIG. 6) of the four food product packages 10 such that each food product packages 10 is fully sealed. Optionally, a cutting station cuts the upper and lower webs such that the food product packages 10 are separated from each other.

Figure 7:
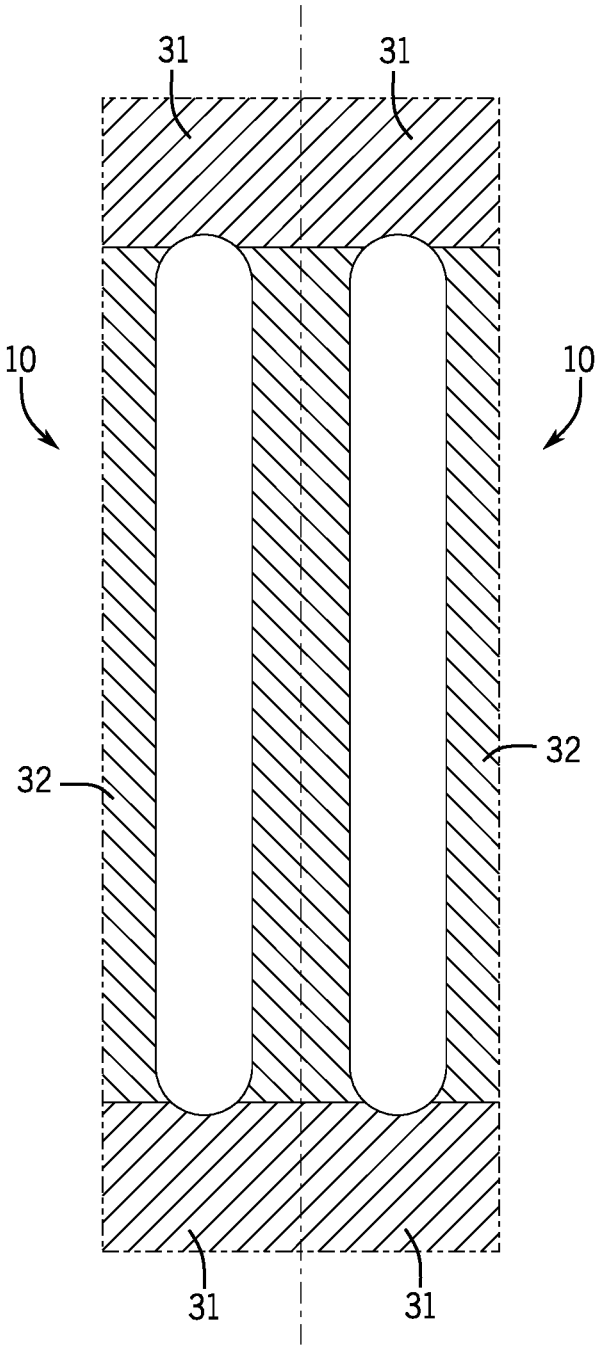
FIG. 7 is an outline of two example food product packages. The first sections (see hatching area) of the food product packages are sealed by a first sealing station such that food product packages are partially sealed. The second sections (see cross hatching area) of the food product packages are sealed by a second sealing station such that the food product packages are fully sealed.

In another example, referring to FIG. 7, two food product packages 10 are sealed at first sections 31 (see hatching areas on FIG. 7, note that the first sections 31 are not contiguous) by the first sealing station 21 (FIG. 2) such that each food product package 10 is partially sealed. The two food product packages 10 are then sealed at the second sections 32 (see cross hatching area on FIG. 7) by the second sealing station 22 (FIG. 2) such that each food product package 10 is fully sealed.

Figure 8:
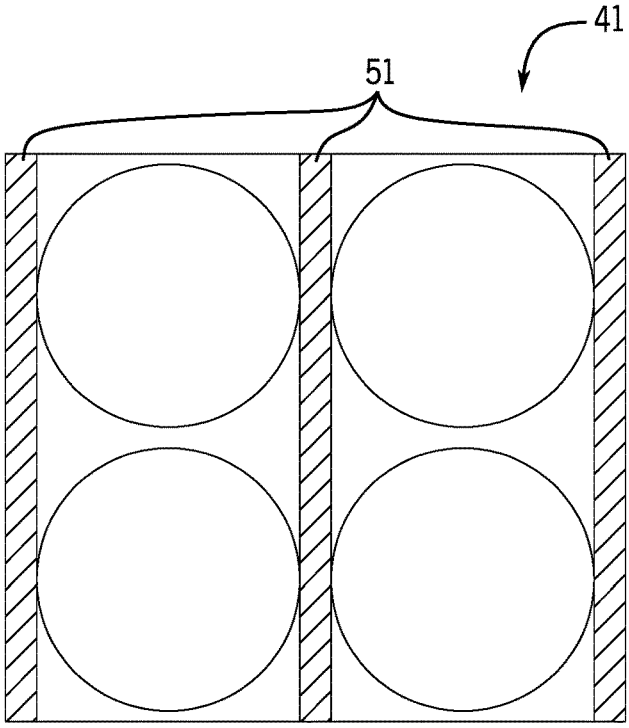
FIG. 8 depicts a first die member that is positioned at the first sealing station. The first die member has a first seal surface (see hatching areas) that corresponds to the first section(s) of the food product package(s).
Figure 9:
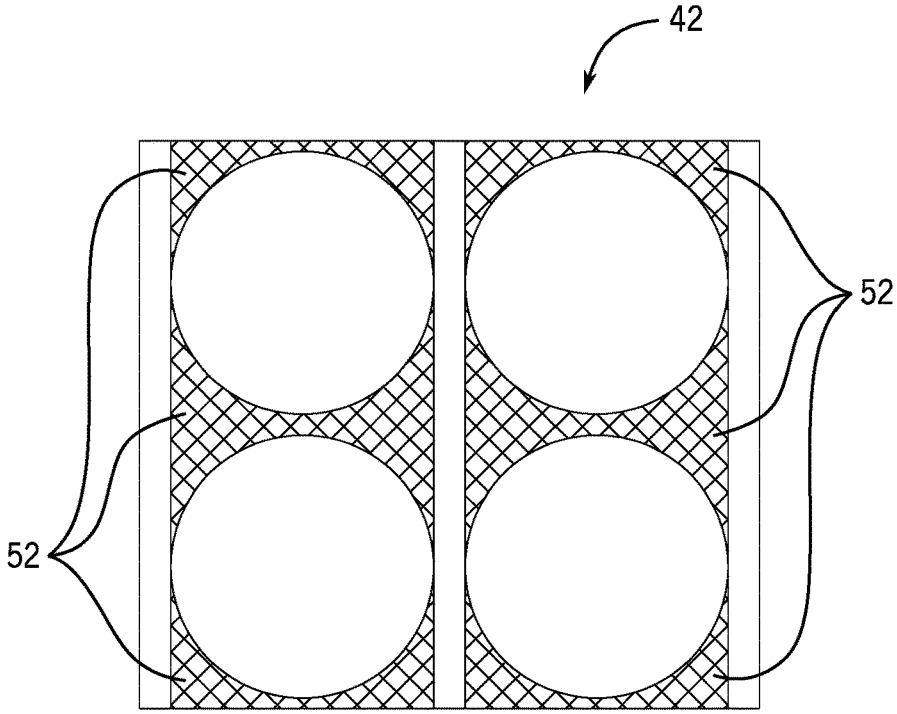
FIG. 9 depicts a second die member that is positioned at the second sealing station. The second die member has a second seal surface (see cross hatching areas) that corresponds to the second section(s) of the food product package (s).

Referring now to FIGS. 8-9, the sealing stations 21, 22 (FIG. 2) each include a seal surface that contacts and seals the upper web of packaging material to the lower web of packaging material to thereby partially or fully seal the food product package 10, as described above. FIG. 8 depicts a first sealing die member 41 that is positioned at the first sealing station 21 (see FIG. 2). The first sealing die member 41 has a first seal surface 51 (see hatching area on FIG. 8) that is configured to contact and seal the upper web of packaging material to the lower web of packaging at the first section(s) 31 of the food product package(s) 10 (FIG. 5). In this example, the first seal surface 51 comprises three, non-contiguous portions that correspond to the first section (s) 31, i.e. the side areas, of four food product packages.

FIG. 9 depicts a second sealing die member 42 that is positioned at the second sealing station 22 (FIG. 2). This second sealing die member 42 has a second seal surface 52 (see cross hatching area on FIG. 9) that is configured to contact and seal the upper web of packaging material to the lower web of packaging at the second section(s) 32 of the food product package(s) 10. The second seal surface 52 comprises several contiguous and non-contiguous portions that correspond to second section(s) 32, i.e. the ends and interior areas, of four food product packages. The second seal surface 52 complements the first seal surface 51 such that the food product package(s) 10 are fully sealed (i.e. the first seal surface 51 and the second seal surface 52 match together such that each food product package 10 is sealed by the web packaging machine 1).

In certain examples, the second seal surface 52 is larger than the first seal surface 51 such that the second seal surface 52 is configured to further seal an overlap area 34 (see FIG. 4 the thick solid line bounded by a centerline (dashed line) of the food product package 6 and the line segments adjacent to the centerline) of the first section 31 of the food product package 10. In this example, the second sealing station 25 (FIG. 2) permanently seals the lower web of packaging material to the upper web of packaging material at the overlap area 34, i.e. the overlap area 34 is a permanent seal that prevents the upper web of packaging material from being separated from the lower web of packaging material. A person having ordinary skill in the art will recognize that the sealing die members 41, 42 can have any number of sealing surfaces (e.g. the second sealing die member 42 has a second sealing surface and a third sealing surface).

Figure 10:
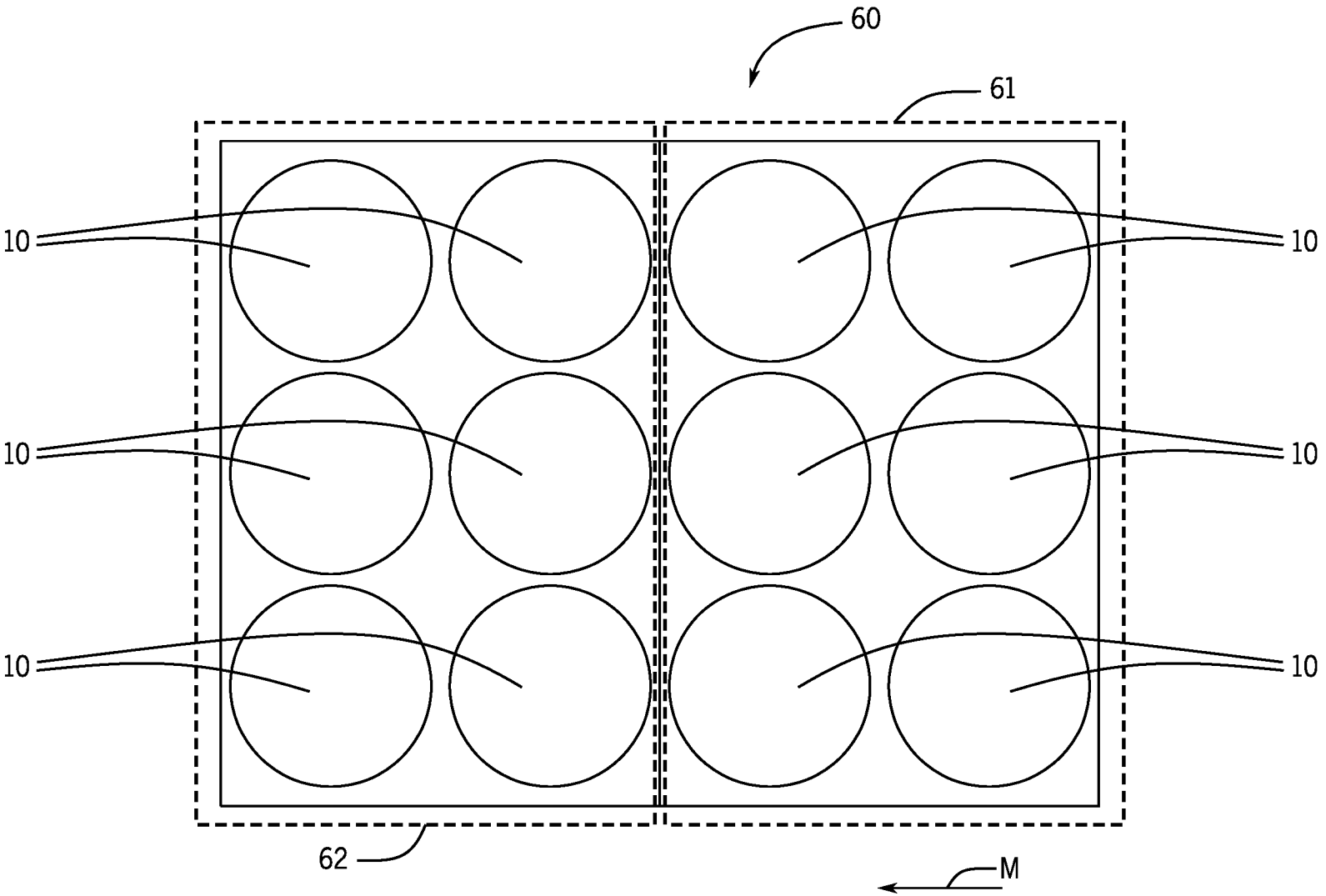
FIG. 10 is an outline of an example food product matrix having twelve food product packages.
Figure 11:
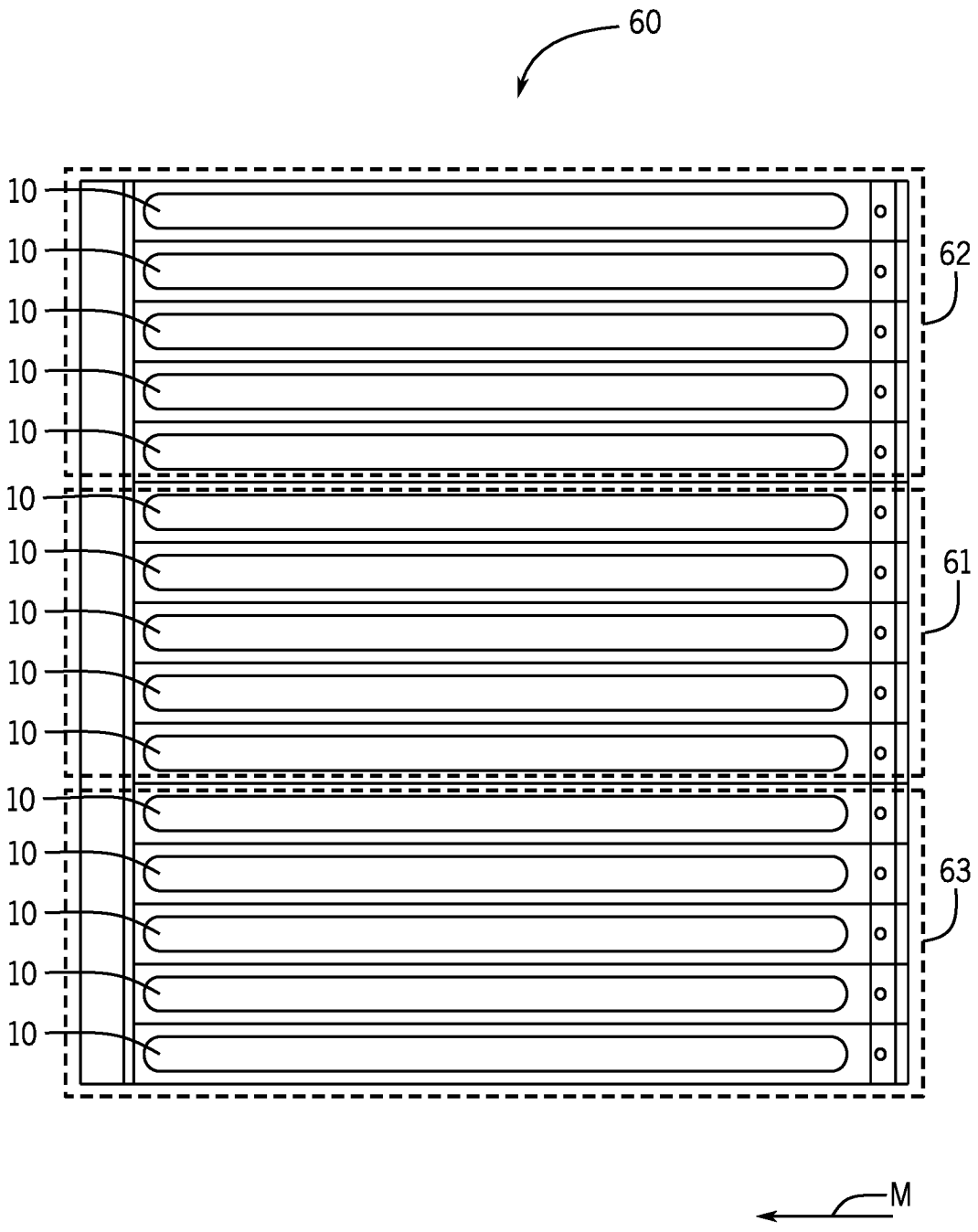
FIG. 11 is an outline of an example food product matrix having fifteen food product packages.

Referring to FIGS. 10-11, each sealing stations 21, 22 (FIG. 2) can be configured to fully seal different food product packages 10 in a food product matrix at different sealing stations 21, 22. That is, the first sealing station 21 is configured to seal the upper web of packaging material to the lower web of packaging material to thereby fully enclose multiple food products in a corresponding number of fully sealed food product packages of the food product matrix. The remaining, unsealed food product packages remain unsealed until the food product packages 10 are moved to the second sealing station 22 where the upper web of packaging material is sealed to the lower web of packaging material (i.e. all the food product packages, including the sealed and unsealed food product packages move or linearly index together from the first sealing station to the second sealing station). That is, the second sealing station 22 is configured to fully seal the remainder of the food product packages in the food product package matrix 60. In the example depicted in FIG. 10, the food product matrix 60 has twelve food product packages 10, the first sealing station 21 encloses six food products in six food product packages 10 (see dashed line 61 that encircles the six food product packages that are fully sealed by the first sealing station 21), and the second sealing station 22 fully encloses six food products in a remaining six food product packages 10 (see dashed line 62 that encircles the six food product packages that are fully sealed by the second sealing station 22). A person having ordinary skill in the art will recognize that any number of food products (e.g. a first food product, a second food product, a third food product, etc.) can be fully sealed in a corresponding number of food product packages included in a food product package matrix 60 (e.g. a first food product package, a second food product package, a third food product package, etc.), respectively.

In another example depicted in FIG. 11, the food product package matrix 60 includes fifteen food product packages 10. An interior, five food product packages 10 of the food product package matrix 60 (see dashed line 61 that encircles five food product packages 10) are fully sealed by the first sealing station 21. The remaining food product packages 10 in the food product matrix 60 (see dashed lines 62, 63 that encircle the remaining two sets of five food product packages 10) remain unsealed until the food product package matrix 60 is moved (see motion arrow M) to the second sealing station 25. Note that the interior, five food product packages (see dashed line 61) are positioned between the other food product packages (see dashed lines 62, 63). The second sealing station 25 is configured to seal the upper web of packaging material to the lower web of packaging material to thereby fully seal the remaining, ten food product packages 10 (see the food product packages 10 encircled by dashed lines 62, 63). A person having ordinary skill in the art will also recognize that the number of seal surfaces 51, 52 of the sealing die members 41, 42 (see FIGS. 8-9) can correspond to the number of food product package(s) 10 that are sealed at each sealing station 21, 22 (FIG. 2) (e.g. the first seal surface corresponds to the first food product package, the second seal surface corresponds to the second food product package, a third seal surface corresponds to a third product package).

Figure 12:
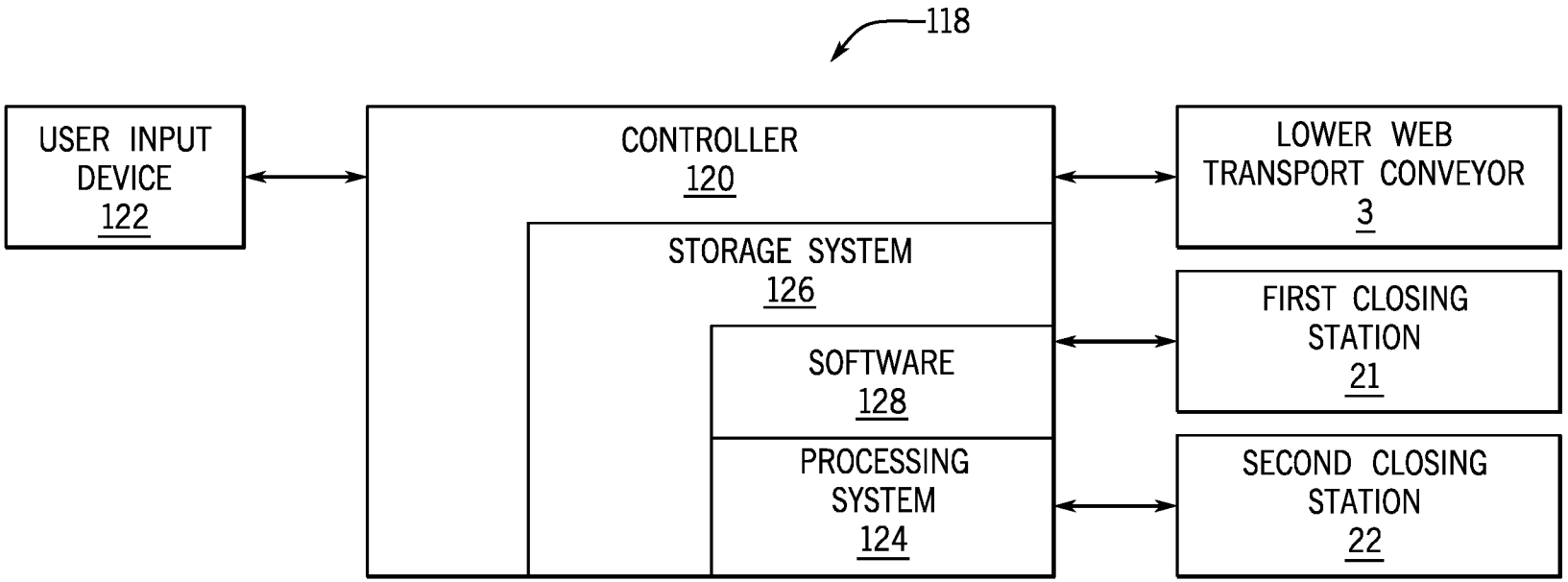
FIG. 12 is a computing system diagram.

Referring to FIG. 12, the web packaging machine 20 (FIG. 2) includes a controller 120 configured to control the components of web packaging machine 20. The controller 120 is part of a computing system 118 included with web packaging machine 20. The computing system 118 includes a user input device 122 that allows the operator to input information into the computing system 118 to control the web packaging machine 20.

The controller 120 includes a processing system 124, storage system 126, and software 128. The processing system 124 loads and executes software 128 from the storage system 126. When executed by the controller 120, the software 128 directs the processing system 124 to operate to carry out the methods described herein.

It should be understood that one or more software application modules could be provided within the software to carry out the same operation. Similarly, while description as provided herein refers to a controller 120 and a processing system 124, it is to be recognized that implementations of such systems can be performed using one or more processors, which may be communicatively connected, and such implementations are considered to be within the scope of the description.

The processing system 124 can comprise a microprocessor and other circuitry that retrieves and executes software 128 from storage system 126. Processing system 124 can be implemented within a single processing device but can also be distributed across multiple processing devices or subsystems that cooperate in existing program instructions. Examples of processing system 124 include general purpose central processing units, applications specific processors, and logic devices, as well as any other type of processing device, combinations of processing devices, or variations thereof.

The storage system 126 can comprise any storage media readable by the processing system 124, and capable of storing software 128. The storage system 126 can include volatile and non-volatile, removable and non-removable media implemented in any method or technology for storage of information, such as computer readable instructions, data structures, program modules, or other data. Storage system 126 can be implemented as a single storage device but may also be implemented across multiple storage devices or sub-systems. Storage system 126 can further include additional elements, such as a controller, capable of communicating with the processing system 124.

Examples of storage media include random access memory, read only memory, magnetic discs, optical discs, flash memory, virtual memory, and non-virtual memory, magnetic sets, magnetic tape, magnetic disc storage or other magnetic storage devices, or any other medium which can be used to storage the desired information and that may be accessed by an instruction execution system, as well as any combination or variation thereof, or any other type of storage medium. In some implementations, the storage media can be a non-transitory storage media. In some implementations, at least a section of the storage media may be transitory. It should be understood that in no case is the storage media a propagated signal.

User input device 122 can include a mouse, a keyboard, a voice input device, a touch input device, a motion input device, and other comparable input devices and associated processing elements capable of receiving user input from a user. Output devices such as a video display or graphical display can display an interface further associated with embodiments of the system and methods as disclosed herein. Speakers, printers, bells and other types of output devices may also be included in the user input device 122. The user input device 122 may display the computing system 118 on a display screen, and/or may announce it via a speaker.

The controller 120 is configured to control and/or operate the web packaging machine 1 and components thereof. The controller 120 is configured to control the lower web transport conveyor 3 to convey the lower web of packaging material from upstream to downstream. The controller 120 is further configured to control the lower web transport conveyor 3 to convey the lower web of packaging material from upstream to downstream in a linear indexing motion.

The controller 120 is configured to control the first sealing station 21 and the second sealing station 22 to seal the upper web of packaging material to the lower web of packaging material to partially and/or fully enclose the food product(s) and seal the food product package(s) 10. The controller 120 is further configured to coordinate simultaneous sealing of the upper web of packaging material to the lower web of packaging material at the first sealing station 21 and the second sealing station 22 in sequential linear indexing motion of the lower web of packaging material.

In certain examples, a web packaging machine that encloses a food product within a food product package formed by a lower web of packaging material and an upper web of packaging material includes a first sealing station configured to seal the upper web of packaging material to the lower web of packaging material to thereby partially enclose the food product in the food product package; a second sealing station configured to further seal the upper web of packaging material to the lower web of packaging material to thereby fully enclose the food product in the food product package; and a lower web transport conveyor configured to convey the lower web of packaging material from upstream to downstream first through the first sealing station and then through the second sealing station. The first sealing station and the second sealing station are spaced apart along the lower web transport conveyor.

In certain examples, a controller is configured to control the lower web transport conveyor so as to convey the lower web of packaging material from upstream to downstream, and wherein the controller is configured to control the first sealing station and the second sealing station to seal the upper web of packaging material to the lower web of packaging material to fully enclose the food product. The controller is further configured to control the lower web transport conveyor in a linear indexing motion, and wherein the controller is configured to coordinate simultaneous sealing of the upper web of packaging material to the lower web of packaging material at the first sealing station and the second sealing station in sequential linear indexing motion of the lower web of packaging material.

In certain examples, the first sealing station seals the upper web of packaging material to the lower web of packaging material along a first section of the food product package to thereby partially enclose the food product in the food product package. The second sealing station seals the upper web of packaging material to the lower web of packaging material along a remaining, second section of the food product package to thereby fully enclose the food product in the food product package. The first sealing station has a first seal surface configured to seal the upper web of packaging material to the lower web of packaging material and the first seal surface corresponds to the first section of the food product package. The second sealing station comprises a different, second seal surface configured to seal the upper web of packaging material to the lower web of packaging material. The second seal surface corresponds to the second section of the food product package. The second seal surface can be larger than the first seal surface. The second seal surface can be configured to further seal an overlap area of the first section of the food product package. The overlap area is a permanent seal that prevents the upper web of packaging material from being separated from the lower web of packaging material.

In certain example a web packaging machine encloses food products within food product packages formed by a lower web of packaging material and an upper web of packaging material. The web packaging machine includes a first sealing station that seals the upper web of packaging material to the lower web of packaging material to thereby fully enclose a first food product in a first food product package; a second sealing station that seals the upper web of packaging material to the lower web of packaging material to thereby fully enclose a second food product in a second food product package; and a lower web transport conveyor that conveys the lower web of packaging material from upstream to downstream first through the first sealing station and then through the second sealing station.

In certain examples, the first sealing station has a first seal surface that contacts and seals the upper web of packaging material to the lower web of packaging material to thereby seal the first food product package. The first seal surface corresponds to the first food product package. The second sealing station has a different, second seal surface that seals the upper web of packaging material to the lower web of packaging material to thereby seal the second food product package. The second seal surface corresponds to the second food product package. In certain examples, the second sealing station can be configured to enclose a third food product in a third food product package. The first food product package can be positioned between the second food product package and the third food product package, and the second sealing station can include a third seal surface that seals the upper web of packaging material to the lower web of packaging material to thereby seal the third product package. The third seal surface corresponds to the third food product package.

What is claimed is:

1. A web packaging machine that encloses a food product within a food product package formed by a lower web of packaging material and an upper web of packaging material, the web packaging machine comprising:

a first sealing station configured to seal the lower web of packaging material to the upper web of packaging material at a first section of the food product package and a second sealing station configured to seal the lower web of packaging material to the upper web of packaging material at a second section of the food product package to thereby fully enclose the food product in the food product package and form a perimeter seal that encircles the food product; and a lower web transport conveyor configured to convey the lower web of packaging material from upstream to downstream first through the first sealing station and then through the second sealing station;

wherein the perimeter seal has a first end, a second end opposite the first end, a first side that extends between the first end and the second end, and a second side opposite the first side that extends between the first end and the second end;

wherein the first sealing station forms the first end, a first portion of the first side, and a first portion of the second side of the perimeter seal to thereby partially enclose the food product in the food product package; and wherein the second sealing station forms the second end, a second portion of the first side that abuts the first portion of the first side, and a second portion of the second side that abuts the first portion of the second side of the perimeter seal to thereby fully enclose the food product in the food product package.

2. The web packaging machine according to claim 1, wherein the first sealing station and the second sealing station are spaced apart from each other along the lower web transport conveyor.

3. The web packaging machine according to claim 1, wherein the first end of the perimeter seal extends parallel to the second end of the perimeter seal.

4. The web packaging machine according to claim 1, wherein the first portion of the first side and the first portion of the second side of the perimeter seal extend parallel to each other and transverse from the first end of the perimeter seal; and wherein the second portion of the first side and the second portion of the second side of the perimeter seal extend parallel to each other and transverse to the second end of the perimeter seal.

5. The web packaging machine according to claim 1, wherein the first sealing station has a first seal surface configured to seal the upper web of packaging material to the lower web of packaging material, wherein the first seal surface corresponds to the first section; and wherein the second sealing station comprises a different, second seal surface configured to seal the upper web of packaging material to the lower web of packaging material, wherein the second seal surface corresponds to the second resection.

6. The web packaging machine according to claim 1, wherein an area of the first section sealed by the first sealing station is also sealed by the second sealing station.

7. The web packaging machine according to claim 6, wherein the second seal surface is larger than the first seal surface.

8. The web packaging machine according to claim 6, wherein the area is a permanent seal that prevents the upper web of packaging material from separating from the lower web of packaging material.

9. The web packaging machine according to claim 1, wherein the first end, the first portion of the first side, and the first portion of the second side of the perimeter seal mirror the second end, the second portion of the first side, and the second portion of the second side of the perimeter seal.

10. A web packaging machine that encloses a food product within a food product package formed by a lower web of packaging material and an upper web of packaging material, the web packaging machine comprising:

a first sealing station configured to seal the lower web of packaging material to the upper web of packaging material and a second sealing station configured to seal the lower web of packaging material to the upper web of packaging material to thereby fully enclose the food product in the food product package and form a perimeter seal that encircles the food product;

wherein the perimeter seal has a first end, a second end opposite the first end, a first side that extends between the first end and the second end, and a second side opposite the first side that extends between the first end and the second end;

wherein the first sealing station forms the first end and the second end to thereby partially enclose the food product in the food product package, wherein the first end is spaced apart and disconnected from the second end and a space is defined between the first end and the second end; and wherein the second sealing station forms the first side and the second side in the space between the first end and the second end to thereby fully enclose the food product in the food product package, wherein the first side and the second side each abut the first end and the second end; and a lower web transport conveyor configured to convey the lower web of packaging material from upstream to downstream first through the first sealing station and then through the second sealing station.

11. A web packaging machine that encloses a plurality of food products within a plurality of food product packages formed by a lower web of packaging material and an upper web of packaging material, the web packaging machine comprising:

a first sealing station configured to seal the lower web of packaging material to the upper web of packaging material to form a first section of each food product package of the plurality of food product packages such that each food product of the plurality of food products is partially enclosed in one of the food product packages of the plurality of food product packages, wherein the first sections abut each other and collectively encircle the plurality of food products;

a second sealing station configured to seal the lower web of packaging material to the upper web of packaging material to form second sections of each food product package of the plurality of food product packages such that each food product in the plurality of food products is individually fully enclosed in one of the food product packages of the plurality food product packages, wherein each food product package is formed by at least one of the first sections and at least one of the second sections; and a lower web transport conveyor configured to convey the lower web of packaging material from upstream to downstream first through the first sealing station and then through the second sealing station.

12. The web packaging machine according to claim 11, wherein the first sections define an exterior seal that encircles the plurality of food products, and wherein the second sections define a plurality of interior seals that separate the food products from each other.

13. The web packaging machine according to claim 12, wherein the exterior seal is rectangularly shaped and wherein each food product package is rectangularly shaped.

14. The web packaging machine according to claim 12, wherein the food product packages of the plurality of food product packages are separated from each other downstream from the first sealing station and the second sealing station.

* * * * *